US007254874B2

(12) United States Patent
Duffy

(10) Patent No.: US 7,254,874 B2
(45) Date of Patent: Aug. 14, 2007

(54) MOLDED SURFACE FASTENERS AND ATTACHMENT METHODS

(76) Inventor: Leonard Arnold Duffy, P.O. Box 99, Hinesburg, VT (US) 05461

( * ) Notice: Subject to any disclaimer, the term of this patent is extended or adjusted under 35 U.S.C. 154(b) by 133 days.

(21) Appl. No.: 11/076,489

(22) Filed: Mar. 9, 2005

(65) Prior Publication Data

US 2005/0198790 A1 Sep. 15, 2005

Related U.S. Application Data

(60) Provisional application No. 60/551,757, filed on Mar. 10, 2004.

(51) Int. Cl.
*A44B 18/00* (2006.01)

(52) U.S. Cl. ..... 24/452

(58) Field of Classification Search ..... 24/445, 24/449, 451, 452
See application file for complete search history.

(56) References Cited

U.S. PATENT DOCUMENTS 3,147,528 A 9/1964 Erb
3,266,113 A 8/1966 Flanagan, Jr.
3,408,705 A * 11/1968 Kayser et al. ..... 24/452
3,522,637 A * 8/1970 Brumlik ..... 24/451
3,526,867 A 9/1970 Kieler, II
3,758,657 A 9/1973 Menzin et al.
4,183,121 A 1/1980 Cousins
4,454,183 A * 6/1984 Wollman ..... 428/92
4,531,733 A 7/1985 Hall
4,671,976 A * 6/1987 Vidal ..... 428/41.8
4,775,310 A 10/1988 Fischer
4,862,563 A * 9/1989 Flynn ..... 24/442
4,894,060 A 1/1990 Nestegard
5,067,210 A * 11/1991 Keyaki ..... 24/452
5,179,767 A * 1/1993 Allan ..... 24/442
5,378,522 A * 1/1995 Lagomarsino ..... 428/100
5,382,462 A 1/1995 Pacione
5,460,769 A 10/1995 Kaneko
5,555,608 A 9/1996 Allan
5,640,744 A 6/1997 Allan
5,655,268 A 8/1997 Keyaki et al.
5,656,226 A 8/1997 McVicker
5,685,050 A * 11/1997 Murasaki ..... 24/449
5,797,170 A 8/1998 Akeno
5,799,378 A * 9/1998 Gershenson et al. ..... 24/452
5,839,172 A 11/1998 Takizawa et al.
5,867,876 A 2/1999 Petersen
5,884,368 A 3/1999 Boe
5,891,549 A 4/1999 Beretta et al.
5,913,482 A * 6/1999 Akeno ..... 24/452
5,943,705 A 8/1999 Sink
5,953,947 A 9/1999 Klein
5,983,467 A 11/1999 Duffy
6,054,091 A 4/2000 Miller et al.
6,061,881 A 5/2000 Takizawa et al.
6,132,660 A 10/2000 Kampfer (Continued)

*Primary Examiner*—Robert J. Sandy

(57) ABSTRACT

Molded surface fasteners are provided which include a fenestrated base structure with sets of at least three undercut segments extending laterally over at least one window, thereby allowing fastening elements of diverse designs to be precisely molded by a set of biparting dies, either as independent attachable products or as an integral part of a product component. Embodiments include fastener portions comprising singular fastening "buttons", portions with recessed fastening zones, unitary double-sided fasteners, products incorporating multiple fastener types in different locations, and unique self-engaging fasteners. Methods for attaching and assembling various components, utilizing the present fastener types are also provided.

19 Claims, 6 Drawing Sheets

Figure 1:
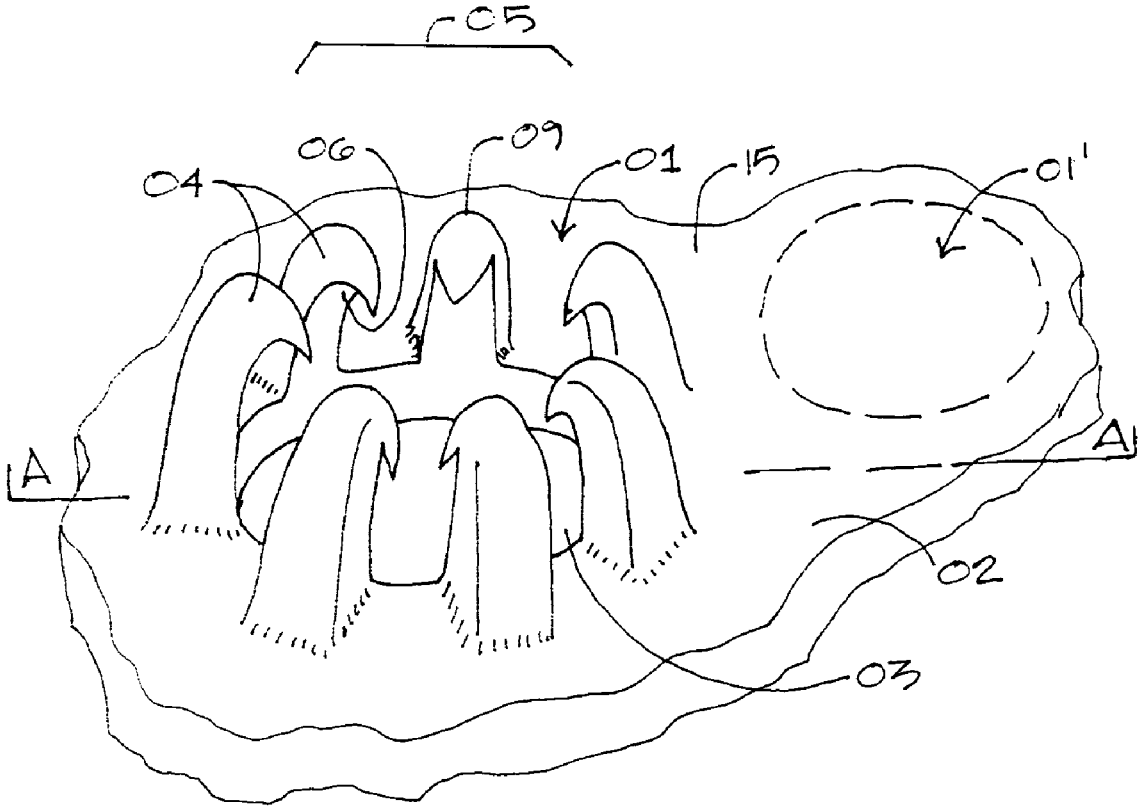

U.S. PATENT DOCUMENTS 6,209,177 B1 4/2001 Murasaki et al.
6,224,364 B1 5/2001 Harvey
6,248,276 B1 6/2001 Parellada et al.
6,258,311 B1 7/2001 Jens et al.
RE37,338 E 8/2001 McVicker
6,317,933 B1 11/2001 Suenaga
6,430,784 B1 8/2002 Dudek et al.
6,430,786 B1 8/2002 Ikeda
6,449,816 B1 9/2002 Dudek et al.
6,478,784 B1 11/2002 Johnson et al.
6,526,633 B2 3/2003 Provost et al.
6,656,563 B1 12/2003 Leach et al.
6,678,924 B2 1/2004 Murasaki et al.
6,684,464 B1 2/2004 Mody et al.
6,687,962 B2 2/2004 Clarner et al.
6,692,674 B1 2/2004 Kurtz et al.
6,694,576 B1 2/2004 Fujisawa et al.
6,708,378 B2 3/2004 Parallada et al.
6,720,059 B2 4/2004 Fujisawa et al.
6,737,147 B2 5/2004 Kennedy et al.
7,048,984 B2 * 5/2006 Seth et al. ..... 428/100
2001/0022012 A1 9/2001 Shephard et al.
2001/0022409 A1 9/2001 Parallada et al.
2002/0129359 A1 9/2002 Murasaki
2003/0074771 A1 * 4/2003 Duffy ..... 24/442

* cited by examiner

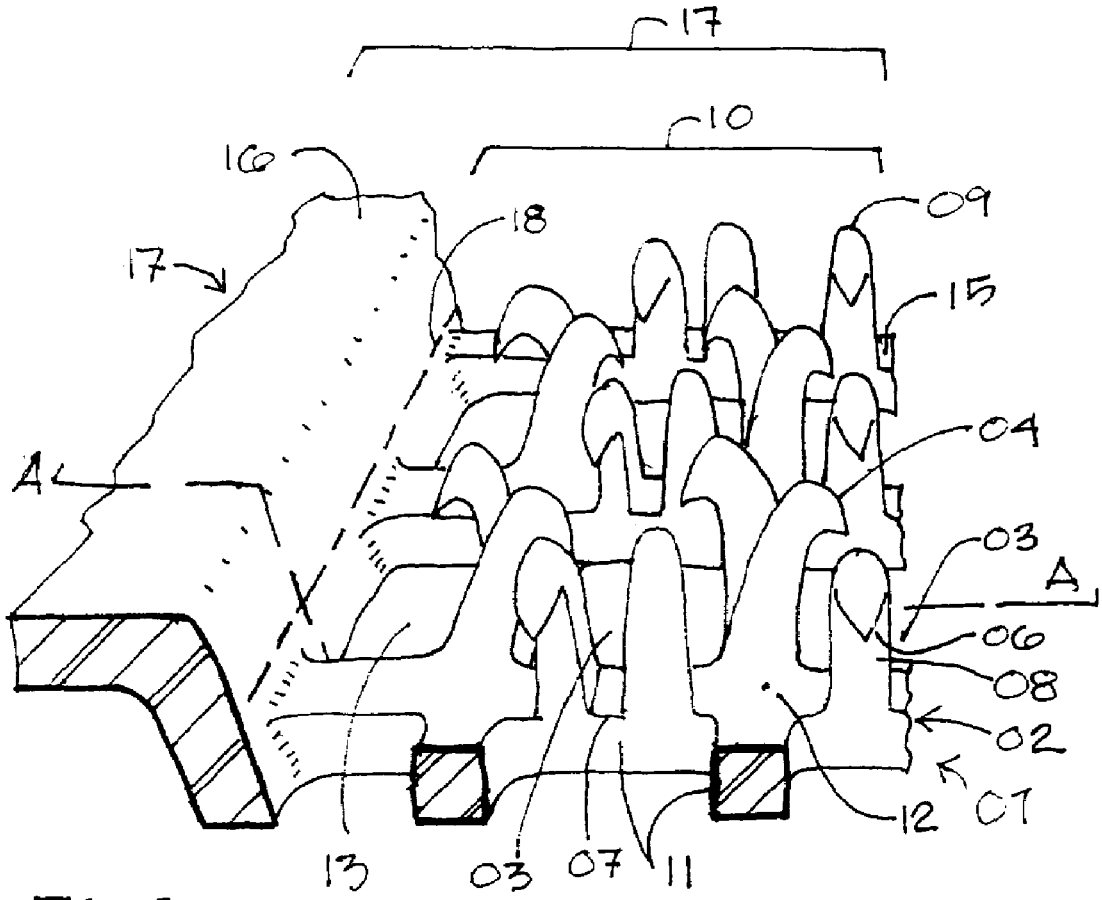
Fig.2
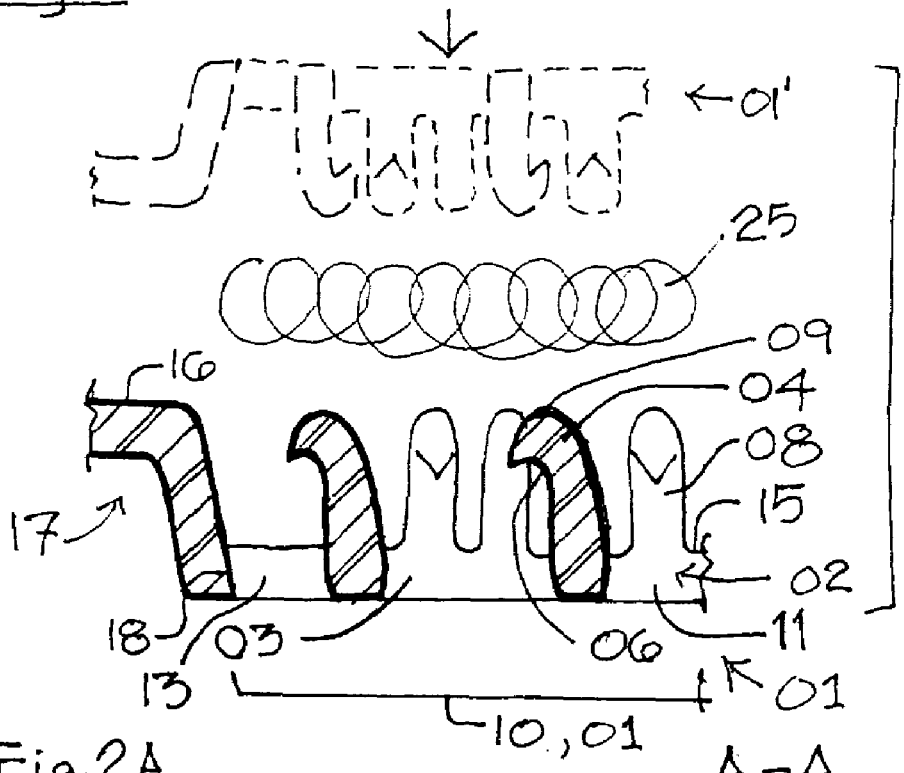
Fig.2A A-A

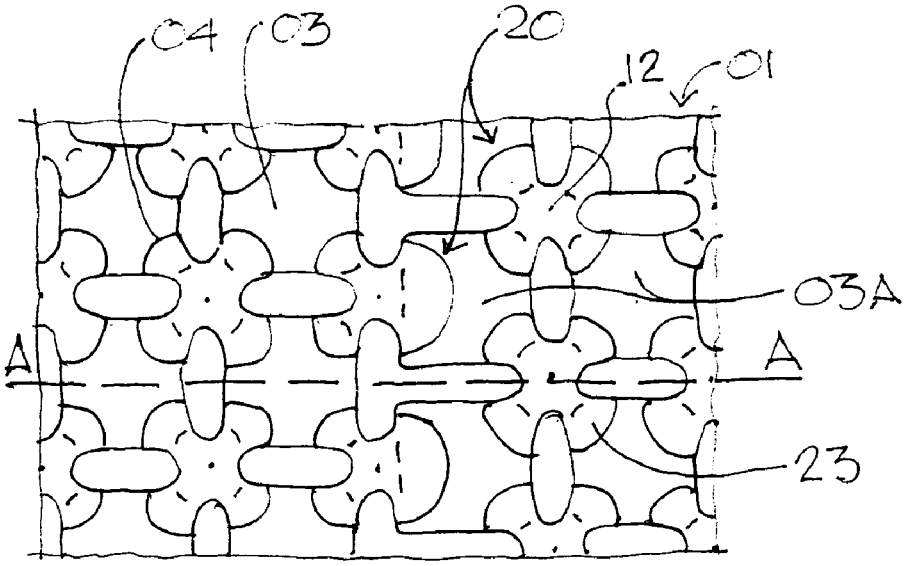
Fig. 4
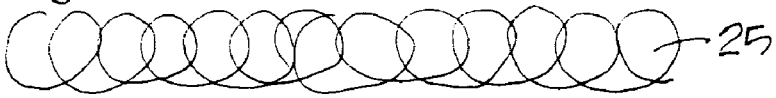
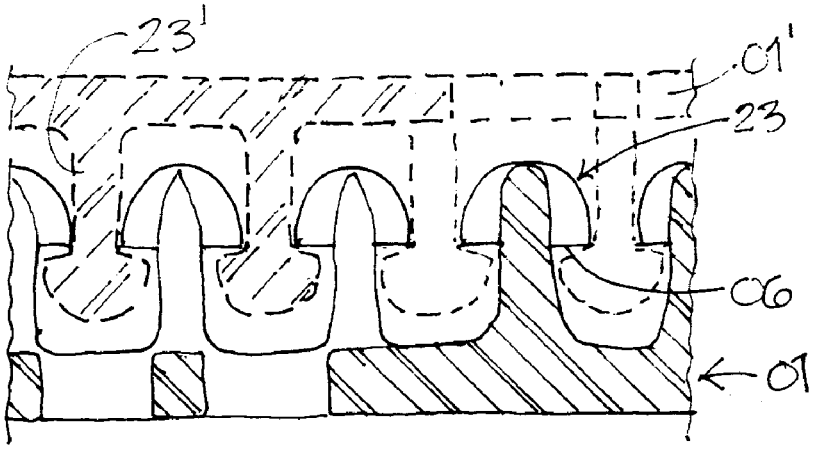
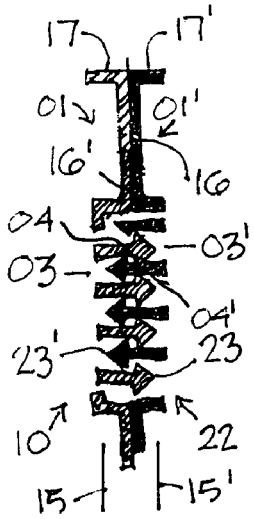
Fig. 4A A-A Fig. 4B

Fig. 5A A-A

Fig. 6A A-A

MOLDED SURFACE FASTENERS AND ATTACHMENT METHODS

PRIORITY

This application claims priority based on Provisional U.S. Patent Application No. 60/551,757 filed Mar. 10, 2004.

RELATED APPLICATION

U.S. patent application Ser. No. 10/015,087 by applicant regarding method of manufacturing.

FIELD

This application relates to molded surface (touch) fasteners of the hook-and-loop and self-engaging (mushroom) types, such fasteners which may be integrally molded, and to methods of using same.

BACKGROUND

The field of surface fasteners, including hook-and-loop and self engaging types, is well established, as evidenced by numerous US and international patents for fasteners and methods of manufacturing since at least the mid $20^{th}$ century. Improvements in the field have largely focused on developing diverse hook and mushroom designs, arraying fastening elements on a surface, increasing hook density, and methods of manufacturing such fasteners in continuous batches by molding or extrusion techniques. In general, these systems include a plurality of hook-like or mushroom-like fastening elements which extend from a generally contiguous sheet form base, with the individual hooks or mushrooms having undersides spaced away from the base.

Molded hookstrips are now often manufactured in a continuous strip on a rotating mold from which individual hooks are stripped by elastically pulling the undercut ends from the mold (for example Jens et al U.S. Pat. No. 6,258,311). Mushroom fasteners as well as some hook fasteners are typically manufactured by first continuously molding a sheet form base with post forms, then heat forming the post ends into a bulbous shape (for example Provost et al U.S. Pat. No. 6,526,633, Parellada et al U.S. Pat. No. 6,708,378 B2).

Typically, both hook-and-loop and self-engaging mushroom fasteners are manufactured as subsidiary products to be attached to a primary product. Fabric like hookstrips are generally contiguous with a woven base and are typically sewn to clothing or flexible materials. Molded hookstrips, as well as self-engaging mushroom systems, are typically molded integrally with a sheet form base which is then attached to a relatively rigid primary product structure by adhesive, welding, or mechanical means. These attachment methods can be problematical in that adhesives may fail, edge peeling often occurs, and they generally result in a relatively thick assembly. Even recently developed "low profile" systems generally have significant thickness which prevents adjoining components from being joined in a flush juxtaposition and are therefore not suitable for many assembly applications. In addition, attached fasteners can be relatively costly for an end product manufacturer in terms of inventory, assembly time, and potential returns. Other factors such as color matching, material compatibility, durability, and material efficiency of the fastener are drawbacks of attached fasteners for many applications. Applications for such attached fasteners are limited by the necessity of attaching the fastener, assuring adhesion, cost, and the relative thickness of the resultant assembly. Therefore, particularly in assembly processes, other methods of attachment are frequently chosen.

In recent years several patents have been issued regarding methods of integrally molding hook-and-loop type hookstrips as part of a primary product (McVicker U.S. Pat. No. 5,656,226, Harvey U.S. Pat. No. 6,224,364 B1, Murasaki et al U.S. Pat. No. 6,678,924 B2). In many instances such integrally molded surface fasteners would appear to be advantageous to industry. However, because these techniques are based upon forcibly removing hook-shaped elements with "blind" undersides from a mold, they appear to be limiting: necessitating complex manufacturing methods; resulting in compromised hook designs of relative weakness; limiting choice of plastic materials; and requiring relatively long dwell times. All of these factors would appear to increase relative cost as well as limit functionality and potential applications.

A few patents and applications have disclosed double-sided surface fasteners (i.e. Kennedy et al U.S. Pat. No. 6,737,147B2, Shepard et al US 2001/0022012 A1, Dudek et al U.S. Pat. No. 6,449,816 B1) Generally these disclosures include means for attaching independently manufactured hookstrip and loop fastener portions in a back to back configuration, resulting in a relatively thick overall assembly when connected.

In pending U.S. patent application Ser. No. 10/015,087, the present applicant has disclosed a method and apparatuses for producing surface fasteners of the slidingly engaging type by utilizing a set of bypassing/biparting dies. This method, among other attributes, allows fastening elements with effectively "blind" undersides to be precisely and economically manufactured with a relatively simple reciprocating molding machine as an integral part of a primary product, or by a continuous molding machine incorporating a rotating die set.

Several examples of prior art include surface fasteners having undercut fastening elements which extend from a fenestrated base structure. Kayaki U.S. Pat. No. 5,067,210 discloses a device having rows of two directional hook sets formed between contiguous structural rows, so as to have a fenestrated base with hook undersides opposite windows in the base. Pacione U.S. Pat. No. 5,384,462 discloses a carpet tape with a fenestrated base structure and hook like elements which do not appear to be related to individual fenestrations. Allan U.S. Pat. No. 5,555,608 discloses (FIG. 19) a somewhat similar structure having individual hooks arrayed in rows of alternating orientation projecting between rows of contiguous structure. In his U.S. Pat. No. 5,640,744, Allan also discloses a fenestrated fastening portion with rib like fastening elements of a similar profile which appears to be double sided. Akeno U.S. Pat. No. 5,797,170 discloses a "mushroom type" fastener wherein individual undersides of each multi-sided fastening element is configured opposite an opening in the fenestrated base structure. Although these examples disclose surface fasteners which appear to be moldable with a byparting die set, their utility seems limited. In each case, the "window" through the base structure is relatively small in relationship to the size of the undercut or "hook" element, which is generally equal to or only slightly larger than the corresponding undercut area. Therefore, hook (or mushroom) density is limited by the number of mold cavities which can reasonably be arrayed in a unit of area because projecting (male) die elements of relatively small dimension would be expected to result in limited mold life. Of the prior art known, only Kayaki provides a system having more than one (two) undercut elements associated with each window, and his invention is further limited in terms of potential hook density and hook orientation by a geometry incorporating singular width rows and columns.

Thus it can be seen by examination of the prior art that there is room for significant improvement in the field. Integrally molded fasteners of both the hook-and-loop and mushroom types which can be manufactured by an improved method would be useful. Inexpensive surface fasteners with greater material efficiency would be beneficial. Fastening elements of diverse designs with precise details which can be economically manufactured without limitation by mold removal requirements is desirable. Fasteners with minimal profile thickness would have great utility. Double-sided fasteners and fastener strips with multiple fastening zones have many potential applications. Improved methods for economically assembling products and components are needed. Other applications for improved surface fasteners will be seen throughout this disclosure.

OBJECTS OF THE INVENTION

A first object of the present invention is to provide surface fasteners which can be economically manufactured. Another object of the invention is to provide surface fasteners which can be integrally molded as part of a primary product. Another object is to provide surface fasteners which can incorporate a diversity of precise fastening element designs, including hooks for attaching to complementary loop structures as well as self-engaging fastening systems. Another object is to provide surface fasteners which incorporate fastening elements arrayed in multidirectional orientations. Another object is to provide surface fasteners which are efficient in material consumption. Another object is to provide unitary surface fasteners with two integral active sides. Another object is to provide surface fasteners having fastening element zones which are recessed or otherwise differentiated from at least part of a surrounding surface. Another object is to provide surface fasteners which incorporate fastening elements of diverse types at disparate surface zones. Another object is to provide surface fasteners which are of very low profile. Another object is to provide methods of attaching and assembling product components utilizing improved surface fasteners. Another object is to provide surface fasteners with relatively high hook density. Another object is to provide "button"-like surface fasteners with fastening elements arrayed in sets about a singular window or cluster of windows in a structure.

DRAWINGS

FIG. 1. Perspective view of a structure having a surface fastener zone comprising a cluster of hook-like fastening elements associated with a window.

Figure 1A:
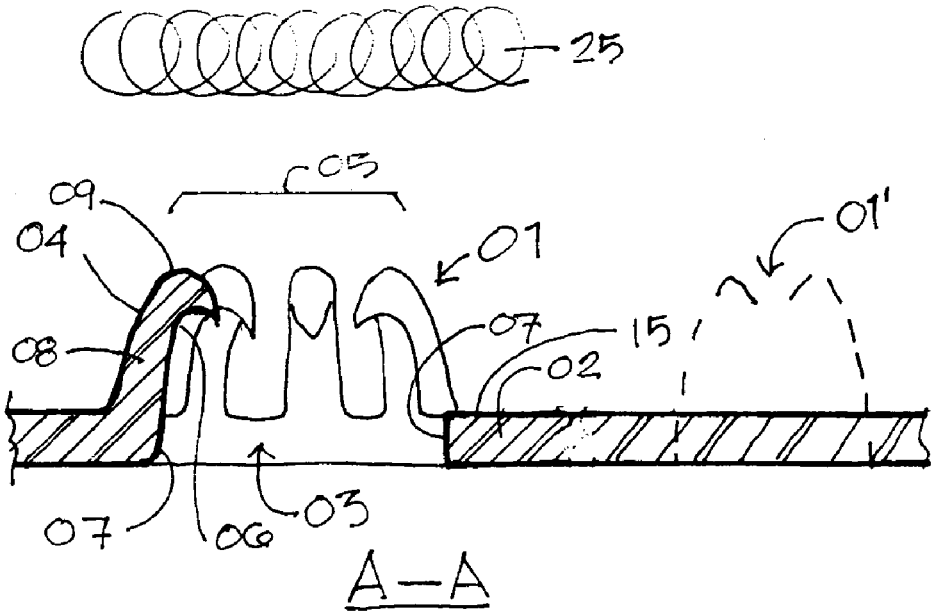

FIG. 1A Section A-A of FIG. 1

FIG. 2. Perspective view of an integrally molded surface fastener portion having sets of fastening elements associated with plurality of windows geometrically arrayed on a fenestrated structure, with fastening elements springing from ribs.

FIG. 2A Section A-A of FIG. 2

Figure 3:
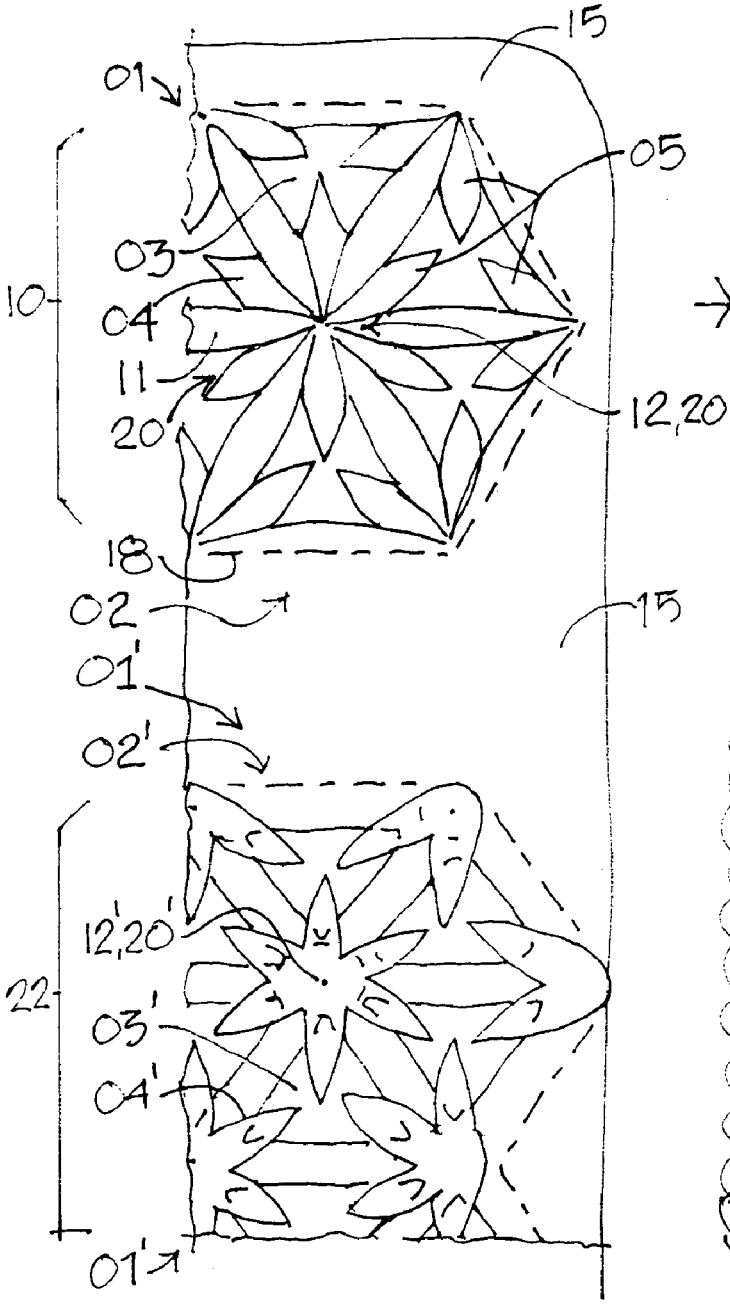
Figure 3A:
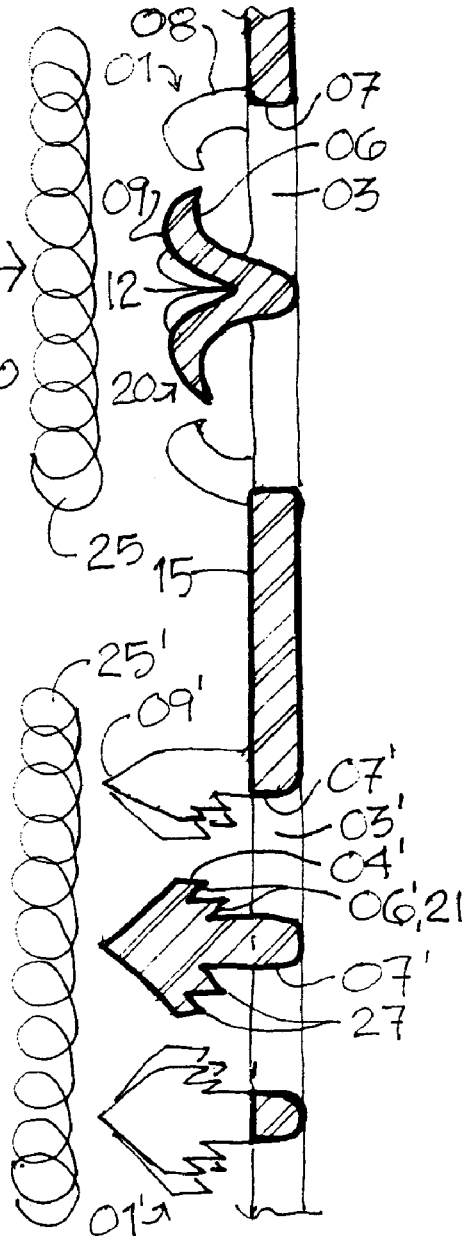

FIG. 3. A molded surface fastener including two distinct fastening zones with fastening elements arrayed in groups at interstices between windows FIG. 3A Section A-A of FIG. 3

FIG. 4. Self engaging surface fastener

FIG. 4A Section A-A of FIG. 4

FIG. 4B Method of Attachment

Figure 5:
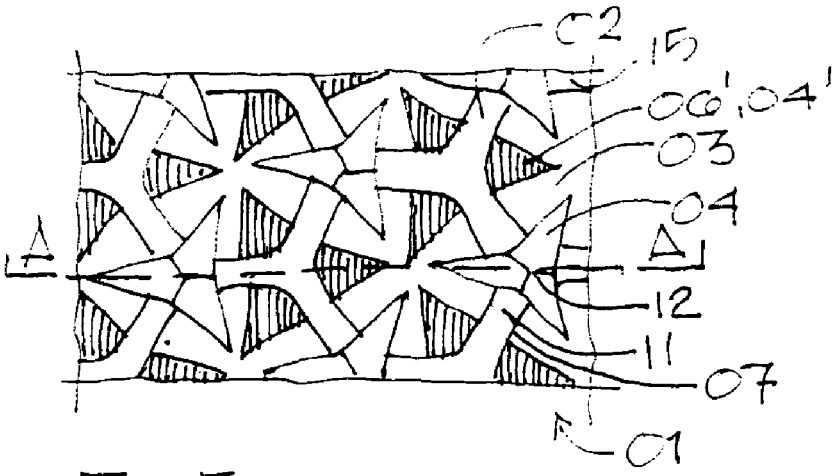

FIG. 5. Double sided hookstrip

FIG. 5A Section A-A of FIG. 5

Figure 5B:
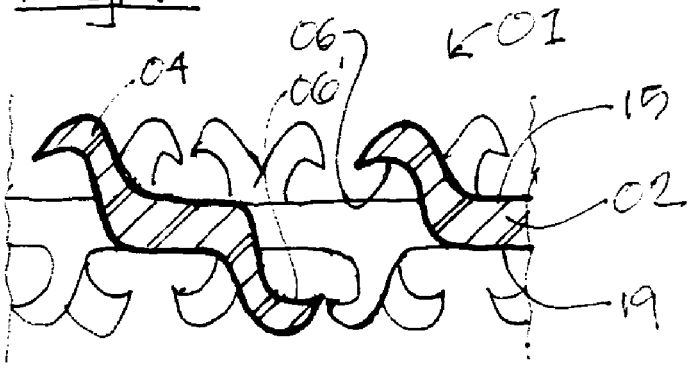
Figure 5B:
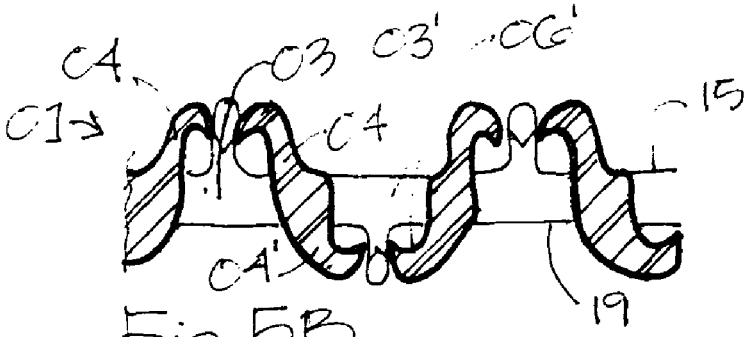

FIG. 5B Alternate Section: Alternating fasteners on opposite surfaces

Figure 5C:
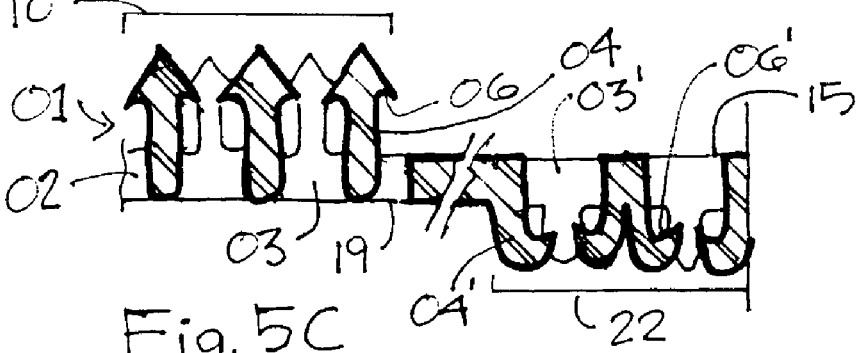

FIG. 5C Alternate Section: Double sided fastener with distinct zones

Figure 6:
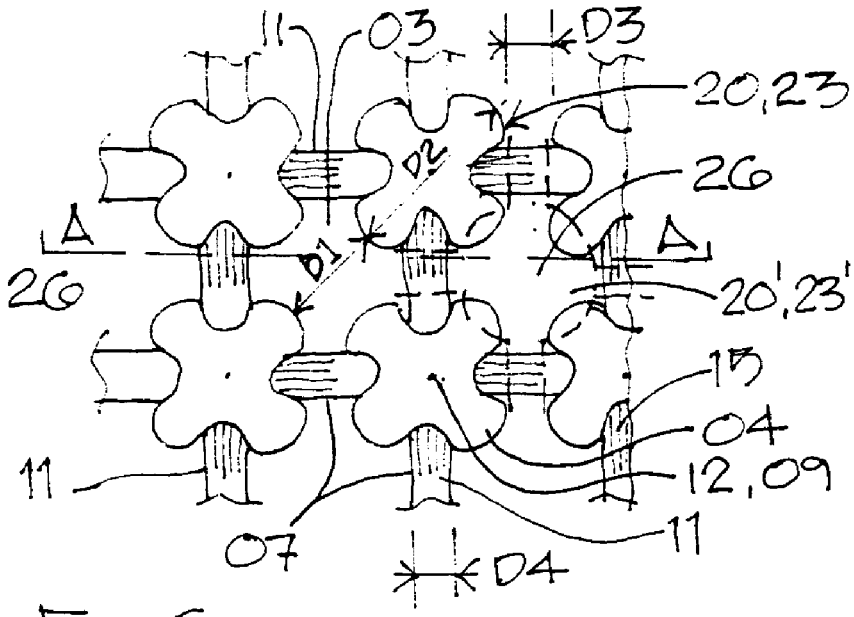

FIG. 6. Low profile self-engaging surface fastener

FIG. 6A Section A-A of FIG. 6

Figure 7:
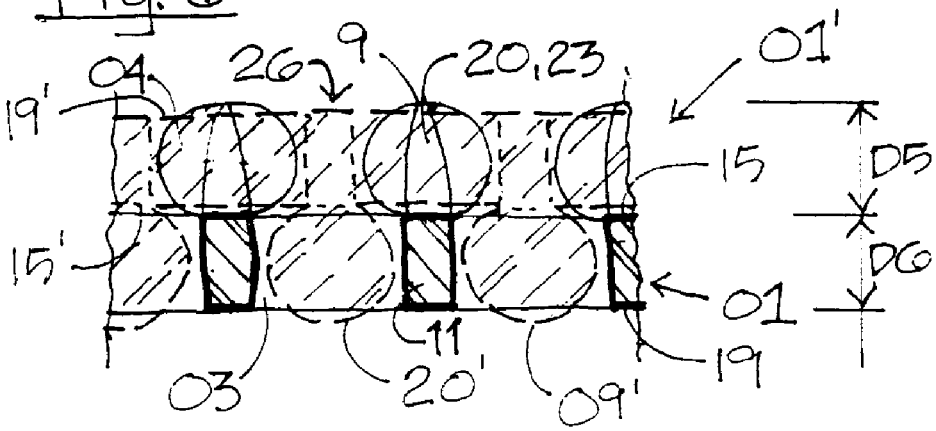
Figure 7:
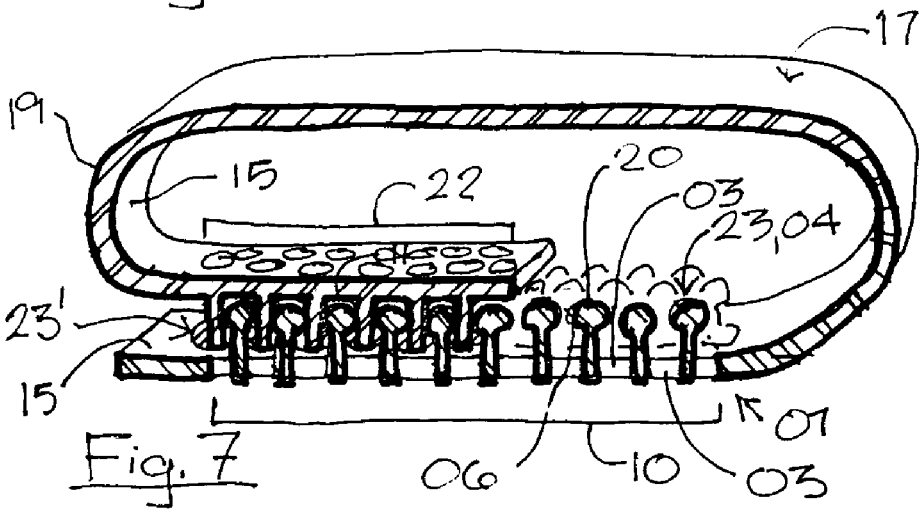

FIG. 7. Product incorporating distinct surface fastening zones on opposite surfaces

SUMMARY OF THE INVENTION

The present invention includes a family of surface fasteners each having a plurality of undercut attachment elements, wherein the elements are arrayed in sets of at least three, with their undercut segments extending laterally over the windows of a fenestrated base structure. The invention includes both "hook" fastener portions of diverse designs for attaching with compatible loop portions, and "self-engaging" fasteners for attaching to like portions, as well as multi-function fasteners for attaching to complementary loops or self-like components.

A significant aspect of the present surface fastener, as seen in any embodiment, is that all surfaces of the various parts may be seen from either one side or the other of the structure: that is, there are no "blind" segments requiring specialized molding methods. The underside of each fastening portion may be readily formed by one part of a biparting die-set, as the upper surfaces of each portion is formed by the other part of such a die set.

This invention also includes diverse embodiments with significant features including: integrally molded systems; examples of many possible geometric configurations; singular button-like fasteners; double-sided fastening portions; fasteners of diverse profile configurations; fasteners of multiple types incorporated on a singular structure; and fastening zones recessed from surrounding structure. The invention also includes methods for using such fasteners to attach and/or assemble various product components.

One of the immediate advantages of the present invention is that surface fastening zones can be integrally molded as part of a primary molded product or component utilizing relatively simple and economical reciprocating molding technology. By associating multiple hook elements with each window, relatively high hook density can be achieved without necessitating exceptionally small and delicate male mold segments. Fastener portions of diverse types with elements of precise design can therefore be economically and rapidly produced.

Another immediate advantage of the present invention is that such relatively high density hook portions can be readily produced, as either stand-alone products or integrated structural components, without limitation relative to extraction of undercut segments from the mold, with little limitation in materials, and reasonably short dwell times in comparison to other known systems for integrally molding hookstrips.

Another advantage is that hook portions for engaging with complementary loop structures, self-engaging systems, or multi-function fasteners can be provided; and can be integrally manufactured as part of a singular product component. Therefore, using the methods taught herein, embodiments of the invention can be incorporated into manufactured product components for attachment to complimentary loop portions, for attaching two components to an intermediary loop portion, for attaching two loop portions with an intermediary double sided hook portion, or for attaching the components directly with a self-engaging embodiment of the invention.

Furthermore, hooks of differing designs can be incorporated within a singular product. For instance a hookstrip or product component may have a first zone of hooks designed for relatively permanent attachment and a second zone with hooks designed for relatively easy release; as in a self attaching fastening tab for a diaper or clothing product. A fastening portion or product component may also include attachment elements extending from, and integral with, both sides of a singular base structure thus providing a means for attaching two overlapping loop-bearing elements.

DESCRIPTION

As can be seen in FIGS. 1-7, the present surface fastening portion 01 includes a fenestrated base structure 02 with at least one window 03 and a plurality of fastening elements 04 arrayed in sets 05 of at least three such elements adjacent to each such window. Each fastening element is configured so that an underside 06 extends laterally over the window. Such fastening portions are preferably but not necessarily manufactured by an apparatus which includes a set of bypassing biparting dies. As used herein, the term "window" refers to an aperture, extending through a generally planar structure, which is defined by an edge 07 at its perimeter. The term "fastening element" is defined as a projection extending from the base structure 02 at edge 07 comprising at least a stem segment 08, a distal end 09, and underside 06. As seen in the drawings FIGS. 1-7, the stem portion of a fastening element 04 may extend obliquely or generally perpendicular relative to the surface 15 of the base structure 02 and may be designed to include various aspects and proportional relationships between its parts, but is typically characterized by having at least one underside 06 extending laterally beyond the edge 07 of an adjacent window 03.

FIGS. 1, 1A schematically illustrates an embodiment of a fastening portion 01 wherein a base structure 02 is fenestrated with at least a singular window 03 having an associated set 05 of at least three fastening elements 04. The undersides 06 of the fastening elements extend laterally from the edge 07 of the window 03 over the window opening, and are spaced from one another at their distal ends 09. In this embodiment, the fastening elements 04 include a hook-like profile intended for engagement with a compatible loop-bearing material 25, of fabric or like structure. Within the scope of this invention, the shape, stem length, spacing between distal ends, and geometry of the fastening elements 04 can be designed to optimize engagement characteristics as well as other factors such as tendency to grab, peel strength, stiffness, profile height, surface texture, etc. Such a set of fastening elements may be readily provided virtually anywhere on the surface of a generally planar structure; as a singular item as shown in FIG. 1, in a random pattern 01', or in a geometric array as in FIGS. 2-7 as generally preferred for many potential applications.

Another optional aspect of the present invention seen in the embodiment of FIG. 1 and others to follow, is that the fastening elements 04 are preferably, though not necessarily, oriented in multiple radial directions. By eliminating the "grain" typical of presently available molded fasteners, this factor provides fasteners which are equally resistive to shear or peeling forces applied in any radial direction.

Factors such as the length of the fastening elements 04 relative to the base, shape, flexibility, etc. may be varied by design within the scope of the invention; longer elements, for instance, generally provide greater flexibility and increased tendency to grab while shorter stiffer elements generally providing stronger adherence and less grab.

FIG. 2 schematically illustrates a segment of an integrally molded embodiment type, recessed from at least part of the surrounding product surface, which includes a fenestrated base structure 02 having a first fastening zone 10 with a plurality of windows 03 arrayed in a geometric pattern. In such a geometric array, the fenestrated structure at the fastening zone effectively comprises a plurality of ribs 11 between adjacent pairs of windows 03, and a plurality of interstices 12 occurring between clusters of at least three adjacent windows. At least some of the windows 03 are associated with sets of at least three fastening elements 04, which fastening elements are adjacent to the edge 07 of each such window and include undersides 06 which each extend over the associated window. In this embodiment, stem 08 of each fastening element 04 can be seen to effectively extend from the fenestrated structure's ribs 11 and are here arrayed in a geometric pattern wherein sets of four hook-like fastening elements 04 are associated with each window 03. It can also be seen that other windows 13 may be associated with less than three fastening elements 04 as might be located at the perimeter 18 of a fastening zone 10.

The embodiment illustrated in FIG. 2 also discloses an important optional aspect of the present invention wherein a fastening zone 10, integrally manufactured as part of a product component 17, with a fenestrated base structure 02 having a first surface 15, may be recessed or otherwise differentiated from at least part of the surrounding surface 16 of the product component. Thus in this embodiment, the first surface 15 of fenestrated base structure 02 is located in a different plane than at least part of the surrounding surface 16 of the product component. Such a configuration allows the fastening zone 10, which necessarily includes a plurality of small elements relatively vulnerable to damage, to be somewhat protected by the surrounding structure when subjected to a physically harsh environment. Additionally, certain applications may utilize such a differential surface treatment for other functional purposes. This aspect of differentiated surfaces can be effectively applied to any embodiment of the present invention and will also be seen in FIG. 4B.

Such a configuration also allows two product components to be assembled in an essentially flush surface-to-surface juxtaposition, by incorporating appropriate dimensioning, as seen in FIG. 2A by a method which includes: first, providing two fastening portions 01, 01', at least one of which is recessed from its surrounding surface; secondly, attaching a first portion 01 to an intermediary loop-bearing material 25; thence, attaching the second portion 01' to the loop-bearing material 25, so that the portions are effectively assembled in a generally flush disposition.

FIG. 3 schematically illustrates an embodiment type which includes a structure with two distinct fastening zones 10, 22 integrally molded as part of a generally planar fenestrated structure 02 with the first fastening zone 10 having a geometric array of windows 03 and associated hook-like fastening elements 04 so as to provide a button-like cluster, and the second fastening zone 22 also having an array windows 03' with fastening elements 04' of a different design. It can be seen here that the first fastening zone 10 includes fastening elements 04 arrayed in groups 20, located at the interstices 12 of the fenestrated base structure 02 and includes individual fastening elements 04 having distinct independent stems 08 here extending generally obliquely from the surface 15 of base structure 02. The second fastening zone 22 also has a fenestrated structure 02' with windows 03' and associated fastening elements 04' of a different type in which the groups of such elements 04' have a common stem 21, extending generally perpendicular to surface 15, with individual underside segments 06' extending laterally over each associated window 03' adjacent to the common stem 21.

An embodiment such as this, with two or more fastening zones having distinct types of fastening elements can be useful in applications where a differential grip might be desired by utilizing a method which includes attaching the first zone 10 to a first complementary portion, then attaching the second zone 22 to a second complementary portion so as to connect the complimentary portions. By providing the portions with differentiated grip strength such an embodiment could be used as a clothing tab wherein the second zone 22 is effectively permanently attached to a loop-bearing material 25 and the first zone 10 is adjustably attached and/or removed at the point of use. It should also be noted that the fastening elements 04' of the second zone 22 include multiple hook barbs 27, so as to afford enhanced engagement with a complementary loop-bearing material. Providing multiple hook barbs or other relatively precise enhancements in the shape of fastening elements is a distinctive feature of the present invention, wherein such precise definition may be provided by a manufacturing apparatus that includes a die projecting through a window 04, 04' so as to precisely mold the shape of underside 06, 06'.

FIG. 4 schematically illustrates a self-engaging embodiment of the invention in which the fastening elements 04 are also arrayed in groups 20 with a common stem 21 located at interstices 12 between at least three adjacent windows 03. As in other embodiments, the undersides 06 of fastening elements 04 extend laterally over each associated window 03. However, in this type of embodiment, with the distal end 09 of the common stem extending perpendicularly beyond the individual fastening elements 04, each group 20 effectively comprises a bulbous stem 23. A plurality of such bulbous stems 23 manufactured of a relatively resilient material and configured and arrayed relatively closely on a first fastening portion 01 self-engages with a complimentary set of bulbous stems 23' oppositely disposed on a second portion 01' when subjected to a relative compressive force. Therefore, a self-engaging fastener is provided by this type of embodiment. Such self-engaging systems, as in prior art, are preferably furnished with an unaligned pattern so as to allow random engagement and enhance shear resistance; one means of providing such a pattern is illustrated here by offsetting window rows 03, 03A. Furthermore, in that the undersides 06 of fastening elements 04 in this instance also have an essentially hook-like profile, such a multiple-functioning embodiment can alternatively be utilized for engaging with a complementary loop-bearing material 25 as well as for self-engaging.

As in the embodiment illustrated in FIG. 2, self-engaging fastening portions can also be recessed relative to the surface of a surrounding structure. Therefore, as schematically illustrated in FIG. 4B, two product components 17, 17' may be securely assembled in a flush surface-to-surface juxtaposition by providing at least the first portion 01 with a first fastening zone 10 comprised of a plurality of bulbous stems 23 which zone is recessed from a surrounding surface 16, then providing a complementary second portion 01' with a complimentary second fastening zone 22, wherein both portions are dimensioned so that when the portions are self-engaged by application of a relative compressive force, the first surrounding surface 16 effectively engages in a flush disposition with the second surrounding surface 16'.

FIG. 5 schematically illustrates an embodiment type which provides a double-sided fastener portion. A fenestrated base structure 02 includes windows 03 each having a plurality of associated hook-like fastening elements 04 and 04' extending over the associated window beyond edge 07. In this embodiment, the first set of such fastening elements 04 generally protrude from the first surface 15 of the structure 02, and a second set 04' generally protrude from the second surface 19 which is generally parallel and opposite the first surface.

A double-sided fastener portion such as that shown in FIG. 5 can be used to connect two loop-bearing fabrics or other materials, or to effectively hem a single folded fabric by a method which includes: engaging a first complementary loop-bearing fabric portion with the fastening elements 04 projecting from first surface 15 of the fastening portion; then engaging a second such fabric portion with fastening elements 04' projecting from the second surface 19, effectively sandwiching the fastening portion 01 between the loop-bearing portions, thereby connecting the portions.

It should be appreciated that double-sided fastening portions can be readily provided within the scope of the present invention by at least three distinct means. By a first means, as illustrated in FIG. 5, sets of fastening elements 04, 04' extend from each surface 15, 19 in association with ones of windows 03. By a second means, as in FIG. 5B, fastening elements 04 associated with certain windows 03 extend from the first surface 15, as in previous embodiments, and fastening elements 04' associated with alternate windows 03' extend from the second surface 19. By a third means, as seen in FIG. 5C, a first zone 10 of fastening elements 04 extend from the first surface 15, and a second zone 22 of fastening elements 04' associated with a different plurality of windows 03' extend from the second surface 19 at a different location on the structure.

It should also be noted that as in other embodiments, double-sided fastening portions of the type of FIG. 5 may optionally include differentiated types of fastening elements extending from opposite surfaces as seen in FIG. 5C. Therefore a double-sided fastening portion may be provided within the scope of this invention which, for instance, is designed so that the first surface 15 grips relatively securely to provide a relatively permanent connection while the second surface 19 grips less firmly to provide intermittent reclosure and adjustment; as might be useful for a diaper closure, clothing "button", or other application. Likewise, a double-sided fastening portion can be provided with hook-like fastening elements 04 extending from a first surface 15 and self-engaging fastening elements extending from second surface 19. Furthermore, a double-sided self-engaging strap may be readily provided with fastening zones functioning on opposite surfaces at separate locations as will be seen in FIG. 7.

An alternative type of self-engaging fastener is illustrated in FIG. 6 which provides a very low-profile fastening system. In this embodiment groups 20 of fastening elements 04 are located at interstices 12 of the fenestrated base structure 02 wherein windows 03 are arrayed in a generally quadrille pattern. The groups of fastening elements 20 share a relatively short bulbous common stem 23 which projects above the first surface 15, preferably by a distance D5 approximately equivalent to the thickness of the fenestrated base structure D6 as measured between the first 15 and second 19 surfaces. Sets of fastening elements 04 extend over each window 03 and define a receiving aperture 26 with a diagonal dimension D1 which is at least slightly less than the dimension D2 as measured diagonally across a typical group 20 of enjoined fastening elements 04. Dimension D3 as measured between groups 20 in a rectilinear direction is at least equal to the width D4 of a typical rib 11. Therefore, when at least the segment of fastening element 04 which extends laterally over each window 03 is manufactured of a sufficiently resilient material, a second such fastening portion 01', oriented in an opposed disposition may be compressed into engagement with the first fastener portion 01 so that groups of fastening elements 20' are effectively contained within windows 03 and ribs 11' of fenestrated structural base 02' are contained between adjacent bulbous stems 23. Therefore, the resilient fastening elements 04, 04' effectively contain groups 20, 20' of respective complementary portions 01, 01'.

It can be appreciated that, unlike other embodiments, the embodiment of FIG. 6 requires that the portions 01, 01' be generally prealigned before compressing them into engagement and that this type of embodiment is preferably provided in a quadrille pattern. However, by manufacturing the portions so that the groups 20 of combined fastening elements 04 with a common stem 21 have a generally bulbous configuration 23 with distal end 09 protruding beyond the lateral bulbous projections, the portions 01, 01' will tend to at least partially self-align as the protruding distal ends 09 of the common stems 21 begin to enter receiving aperture 26, thereby allowing an approximately aligned pair of portions to become fully aligned in a pre-engaged disposition, prior to full engagement by the relative compressive force.

A product component 17 having integrally molded zones 10, 22 of self-engaging fastening elements and their associated windows is schematically illustrated in FIG. 7. In this embodiment, intended to exemplify one of many possible configurations, a first zone 10 of fastening elements 04 protruding from first surface 15 of a flexible contiguous strap, and a second zone 22 of fastening elements 04' protruding from a second surface 19 elsewhere on the strap. In that the groups 20 of fastening elements with bulbous common stems 23, 23' are designed and arrayed so as to self-engage as in FIG. 4 above, thereby a unitary adjustable self-engaging strap useful for many common applications is provided as one example of many possible applications of the present invention.

It is to be understood that the illustrations and specifications herein are intended to generally describe the various aspects of this invention and are not limiting, and furthermore that such aspects man be combined in manifold ways to produce a wide variety of useful applications within the scope of the invention. Having fully described my invention I hereby claim the following.

The invention claimed is:

1. A first fastener portion for compressively engaging with a complementary second fastener portion, said first fastener portion comprising:

a fenestrated base structure having at least one window and a generally planar first surface and;

at least three first fastening elements associated with each said window, each said fastening element contiguous with said base structure and spaced apart from adjacent said fastening elements associated with each said window and including:

a stem segment protruding from said first surface of said base structure adjacent to the edge of said window contiguous with an underside spaced away from the effective plane of said first surface and extending laterally over a portion of said window, said underside for attaching to complementary second fastening elements associated with said second fastener portion when said first and second fastener portions are compressively engaged;

whereby, compressively engaging said first fastener portion with said complementary second fastener portion causes at least said second fastening elements to temporarily resiliently deform, so that a plurality of said undersides engage with said complementary second fastening elements when said fastening elements resiliently revert to their original general disposition, thereby engaging and fastening said first and second portions.

2. A first fastener portion as in claim 1, wherein said first fastening elements have a generally hook-like profile, and said complementary second fastener portion includes a loop bearing material with complementary loop-like second fastening elements for engaging with said undersides of said first fastener portion.

3. A first fastener portion as in claim 1 having a plurality of said windows, wherein groups of adjacent said first fastening elements each associated with adjacent said windows include a common stem segment.

4. A first fastener portion as in claim 1 wherein said first-fastening elements are configured and arrayed so as to self-engage with said second complementary fastening elements likewise configured and arrayed on said second fastener portion.

5. A first fastener portion as in claim 1 also having a second surface generally parallel with and spaced from said first surface, wherein a first plurality of said first fastening elements protrudes from said first surface of said base structure, and also including a second plurality of second fastening elements protruding from a second surface of said base structure, so as to provide a double-sided fastening portion.

6. A first fastener portion as in claim 5 wherein said first fastening elements are of a first design type and wherein said second fastening elements are of a distinct second design type.

7. A first fastener portion as in claim 1, having a first plurality of said first fastening elements protruding from a first zone of said structure and a second plurality of said second fastening elements protruding from a second zone of said structure wherein said first zone is distinct and separated from said second zone by an intervening zone of said structure absent said fastening elements.

8. A first fastener portion as in claim 7, wherein said first fastening elements are of a first design type and said second fastening elements are of a second design type distinct from said first design type.

9. A first fastener portion as in claim 1 wherein said first fastener portion comprises an integral portion of a unitary structural entity.

10. A first fastener portion as in claim 1, wherein said first surface of said base structure adjacent to said fastening elements generally defines a plane which is distinct from at least portions of a surface plane defined by an adjacent contiguous structure.

11. A method of attaching a first component to a second component, the method comprising the steps of:

providing a first component with a first zone having the first fastener portion according to claim 1, the first fastening portion having hook-like fastening elements;

providing a second component with a second zone of second hook-like fastening elements;

providing an intermediate loop bearing structure;

engaging said first hook-like fastening elements with said loop bearing structure;

engaging said second hook-like fastening elements with said intermediary loop bearing structure, thereby attaching said first component to said second component.

12. A method as in claim 11 wherein said first zone is associated with a first surrounding surface of said first component and said second zone is associated with a second surrounding surface of said second component and wherein at least said first zone is recessed from said first surrounding surface so that, when said components are attached, said first surrounding surface engages said second surrounding surface, whereby said first and second components are assembled in a flush surface-to-surface configuration.

13. A first fastener portion according to claim 1, wherein said first fastening elements are oriented in at least three radial directions.

14. A first fastener portion as in claim 1 wherein said first surface and a first face of said fastening elements are visible from a first direction normal to said first surface, and wherein said underside segments and a second surface opposite and spaced from said first surface are visible from a second direction normal to said second surface, whereby all surfaces of said first fastener portion are visible from a combination of said first and said second directions.

15. A method of attaching a first portion to a complementary second component, said method comprising the steps of:

a. providing said first portion having at least one designated fastening zone;

b. providing a plurality of at least three first fastening elements associated with at least one window at said fastening zone, said first fastening elements including undersides extending laterally over portions of each said at least one window and spaced away from said window;

c. providing said complementary second component with a plurality of resilient complementary second fastening elements, for engaging with said first portion; and d. compressing at least some of said first fastening elements into said complementary second component, so as to cause at least some of said second fastening elements to resiliently deform and engage with said undersides, thereby attaching said first portion to said second component.

16. A method as in claim 15 wherein said first fastening elements are of a hook-like design and said complementary second component is a loop-bearing structure with loops for engaging said undersides.

17. A method as in claim 15 wherein said first fastening elements are configured and arrayed to self-engage with a plurality of said resilient complementary second fastening elements as part of said complementary second component.

18. A method for assembling fabric components comprising the steps of:

providing a first loop bearing fabric component;

providing a second loop bearing fabric component;

providing an intermediary double-sided fastening portion having the fastening portion of claim 5;

engaging hook-like fastening elements protruding from a first side of said double-sided fastening portion to said first fabric component; and engaging hook-like fastening elements protruding from a second side of said double-sided fastening portion to said second fabric component; thereby assembling said fabric components.

19. A double-sided fastener portion for compressively engaging with a plurality of complementary second portions, said double-sided portion comprising a fenestrated singular unitary structure having at least one window communicating between a first surface of said structure, and a second surface of said structure opposite said first surface; with a plurality of hook-like fastening elements protruding from said first surface, each having an underside extending over said at least one window; and a plurality of second hook-like fastening elements protruding from said second surface each having an underside extending over at least one said at least one window.

* * * * *